US010591258B1

(12) United States Patent
Drummond et al.

(10) Patent No.: US 10,591,258 B1
(45) Date of Patent: Mar. 17, 2020

(54) DESK WITH BALLISTIC MATERIAL ATTACHED THERETO

(71) Applicants: Todd Donald Drummond, Kiln, MS (US); Donald James Drummond, Gainesville, FL (US)

(72) Inventors: Todd Donald Drummond, Kiln, MS (US); Donald James Drummond, Gainesville, FL (US)

( * ) Notice: Subject to any disclaimer, the term of this patent is extended or adjusted under 35 U.S.C. 154(b) by 0 days.

(21) Appl. No.: 16/123,116

(22) Filed: Sep. 6, 2018

(51) Int. Cl.

| | |
|---|---|
| ***A47B 41/00*** | (2006.01) |
| ***F41H 5/24*** | (2006.01) |
| ***A47B 39/12*** | (2006.01) |
| *A47B 83/02* | (2006.01) |
| *F41H 5/013* | (2006.01) |

(52) U.S. Cl.
CPC ..... *F41H 5/24* (2013.01); *A47B 39/12* (2013.01); *A47B 41/00* (2013.01); *A47B 83/0213* (2017.08); *F41H 5/013* (2013.01)

(58) Field of Classification Search
CPC ..... A47C 7/628; A47B 41/00; A47B 83/0213; F41H 5/24; F41H 5/013
USPC ..... 108/50.11; 297/174 R, 173, 135
See application file for complete search history.

(56) References Cited

U.S. PATENT DOCUMENTS 1,195,627 A * 8/1916 Thum ..... A47B 39/00 297/172
RE16,410 E * 8/1926 Woolman ..... A47B 41/00 297/143
2,098,655 A * 11/1937 De Lisle ..... A47B 19/06 248/599
2,271,007 A * 1/1942 Hanna ..... A47B 83/02 188/5
2,375,696 A * 5/1945 Shick ..... A47B 19/002 297/174 R
2,579,606 A * 12/1951 Oom ..... A47B 39/02 16/333
2,606,380 A * 8/1952 Buhr ..... D06F 81/00 297/174 R
2,673,595 A * 3/1954 Kump, Jr. ..... A47B 39/04 297/172
3,016,266 A * 1/1962 Caplan ..... A61G 5/00 297/150
3,179,071 A * 4/1965 Johnston ..... A47B 9/14 108/139
4,238,097 A * 12/1980 Clausen ..... A47B 19/06 248/188.7

(Continued)

FOREIGN PATENT DOCUMENTS

WO WO 2012/018986 2/2012

*Primary Examiner* — Jose V Chen
(74) *Attorney, Agent, or Firm* — George L Williamson

(57) ABSTRACT

Method and apparatus for a desk/chair assembly having sheets of ballistic material attached around its top and outer edges and a chair portion also having ballistic material attached thereto for use by the occupant for seating purposes wherein the chair portion is attached to the desk portion using a pivoting arm so as to allow the chair portion to be moved between multiple positions including the normal seated position, an open position and a closed position wherein a user can hide inside a safety zone created by the chair and desk assembly. A pivoting arm is attached to an underside of the desk top on one end and fixedly connected to the underside of the chair seat on its other end. A handle is also provided for moving the chair portion between its various positions.

18 Claims, 5 Drawing Sheets

(56) References Cited

U.S. PATENT DOCUMENTS

| | | | | |
|---|---|---|---|---|
| 5,547,270 | A * | 8/1996 | Dang | A47B 39/00 297/140 |
| 6,170,379 | B1 | 1/2001 | Taylor | |
| 6,622,607 | B1 * | 9/2003 | Miller | F41H 5/06 2/2.5 |
| 7,954,892 | B2 * | 6/2011 | Knighton | A47B 39/00 297/142 |
| 7,988,237 | B2 | 8/2011 | Peters | |
| 8,616,629 | B2 * | 12/2013 | Jonsson | A47B 83/02 297/171 |
| 8,616,630 | B1 * | 12/2013 | Midkiff | A47B 83/02 108/44 |
| 8,701,544 | B2 | 4/2014 | Peters et al. | |
| 9,254,037 | B2 * | 2/2016 | Benden | A47B 39/00 |
| 9,615,658 | B1 | 4/2017 | Nobles et al. | |
| 10,295,311 | B1 * | 5/2019 | Trubacek | F41H 5/18 |
| 2015/0033990 | A1 | 2/2015 | Yeager | |
| 2015/0153143 | A1 | 6/2015 | Hollenbach | |

* cited by examiner

DESK WITH BALLISTIC MATERIAL ATTACHED THERETO

BACKGROUND OF THE INVENTION

Field of the Invention

The present invention relates generally to furniture including desks and, more particularly, is concerned with a desk useful for school purposes having ballistic material attached thereto for safety purposes.

Description of the Related Art

Devices relevant to the present invention have been described in the related art, however, none of the related art devices disclose the unique features of the present invention.

In U.S. Pat. No. 8,701,544 dated Apr. 22, 2014, Peters, et al., disclosed furniture providing ballistic defense shield. In PCT Application International Publication No. WO 2012/018986 dated Feb. 9, 2012, Peters disclosed furniture providing ballistic defense shield. In U.S. Patent Application Publication No. 2015/0153143 dated Jun. 4, 2015, Hollenbach disclosed a bullet resistant desk top. In U.S. Patent Application Publication No. 2015/0033990 dated Feb. 5, 2015, Yeager disclosed a protective student desk. In U.S. Pat. No. 6,170,379 dated Jan. 9, 2001, Taylor disclosed a desk and removable bullet resistant desk top shield. In U.S. Pat. No. 9,615,658 dated Apr. 11, 2017, Nobles, et al., disclosed a desk with a projectile resistant desk top. In U.S. Pat. No. 7,988,237 dated Aug. 2, 2011, Peters disclosed a chair providing ballistic defense shield.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a desk/chair assembly, primarily intended to be a student desk, including a desk portion having sheets or panels of ballistic material attached around its outer edges and a chair portion also having ballistic material attached thereto for use by the occupant for seating purposes wherein the chair portion is attached to the desk portion using a pivoting arm so as to allow the chair portion to be moved between multiple positions including the normal seated position, an open position and a closed position wherein the student or user can hide inside the safety zone created by the chair and desk assembly so that the student can be protected from all types of projectiles including those from fire arms. The desk portion has ballistic material attached on its top and around its sides and the chair portion has ballistic material attached to the seat back and front leg areas so that when the chair/desk assembly is in the fully engaged or closed position the student can be protected inside the safety zone created by the chair/desk assembly. The pivoting arm is attached to an underside of the desk top on one end and fixedly attached to the underside of the chair seat on its other end. A handle is also provided on the lower side of the front of the seat so that a student user can easily grasp the chair portion and move it between its various positions.

An object of the present invention is to provide a safety zone for use inside of a school room to allow a student/user to be protected during a school shooting incident. A further object of the present invention is to provide a safety zone for use with a school desk wherein the student/user can quickly convert the desk into a safety zone for protecting the student/user. A further object of the present invention is to attach ballistic material to a desk and chair assembly so that a student/user can be protected by concealing himself underneath the desk so as to be substantially surrounded by ballistic material in order to protect the student/user. A further object of the present invention is to provide a safety zone desk having ballistic material attached thereto which can be easily operated by a user. A further object of the present invention is to provide a safety zone desk which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
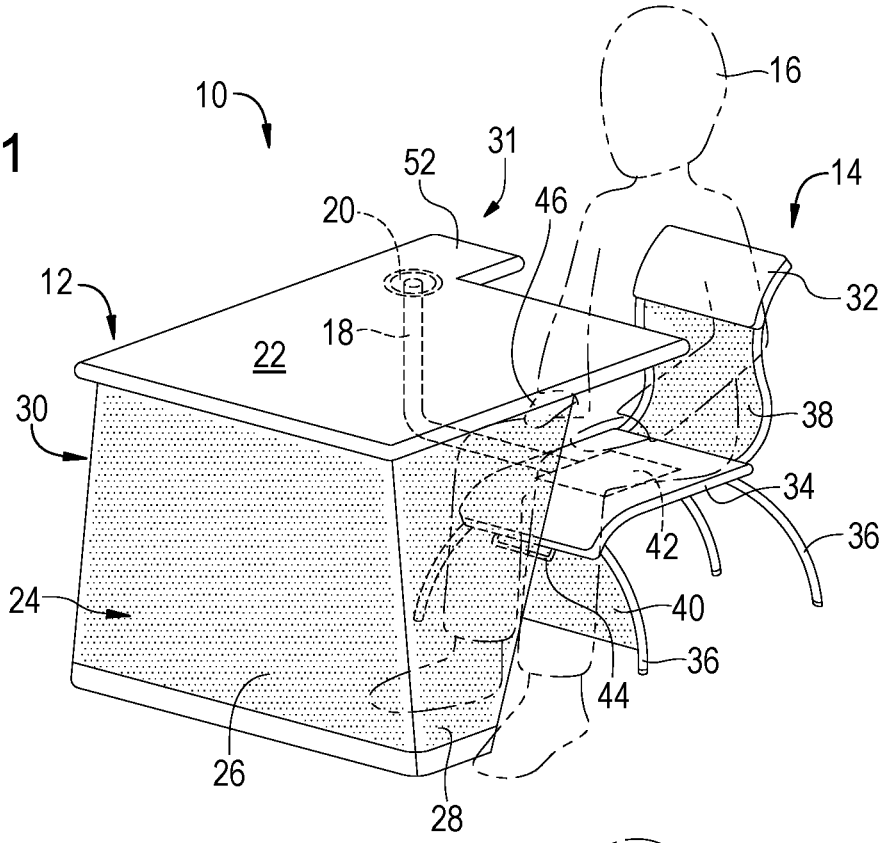
FIG. 1 is a perspective view of the present invention shown with a student/user in the normal or static position.

With regard to reference numerals used, the following numbering is used throughout the drawings.

10 present invention
12 desk
14 chair

16 user
18 arm
20 pivot
22 top
24 ballistic material
26 front side
28 left side
30 right side
31 rear portion
32 back of chair
34 seat of chair
36 legs of chair
38 back ballistic material
40 leg ballistic material
42 plate
44 handle
46 hand of user
48 space/safe zone space
50 notch
52 arm rest/extension
54 framework
56 angle iron member
58 channel member
60 platen member
62 outer cover
64 detent plate
66 detent hall/spring
68 detent cavity
70 bushing
72 stop pin
74 teflon surface
76 screw/fastener
78 rotating plate
80 leg
82 adjustable foot

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 14 illustrate the present invention wherein a safety zone desk is disclosed and which is generally indicated by reference number 10.

Figure 2:
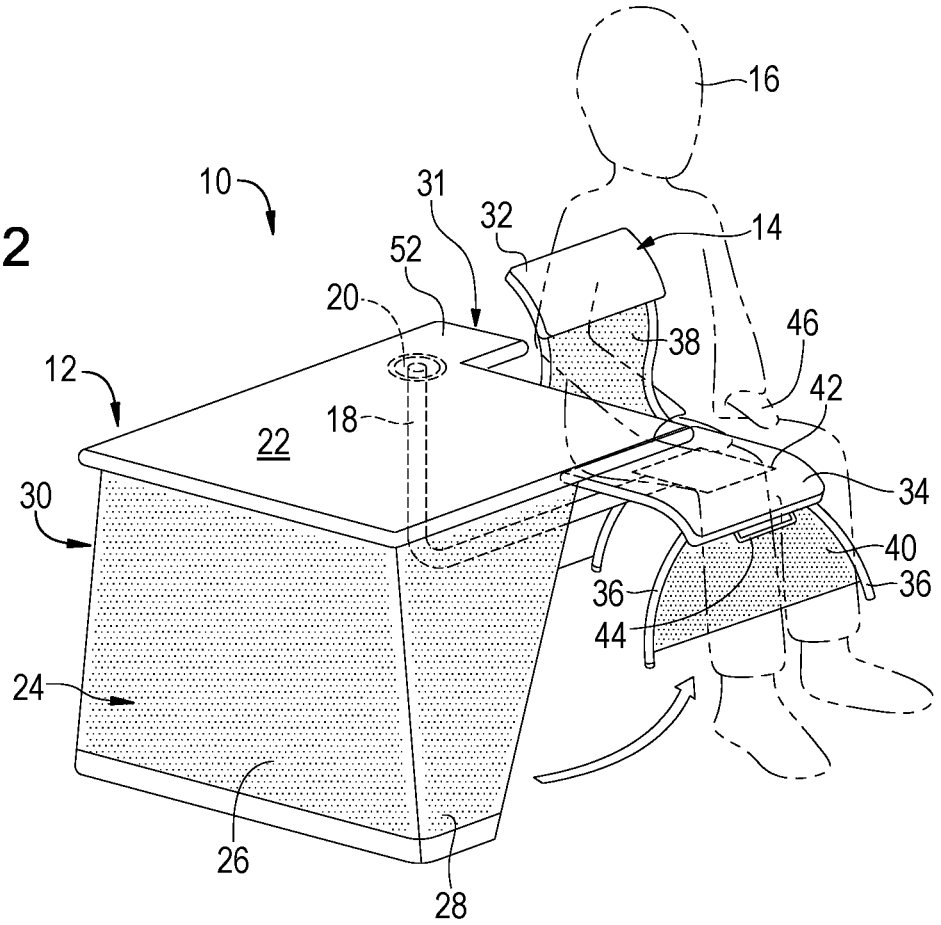
FIG. 2 is a perspective view of the present invention shown with a student/user in an open or access position.

Turning to FIGS. 1-2, therein is shown the present invention 10 a desk/chair assembly having a desk portion 12 and a chair portion 14 in which a user 16 is seated, wherein the chair portion is connected to the desk portion using an arm 18 pivotally attached at 20 to an underside of the top 22 of the desk portion 12. The desk portion 12 is covered and shielded using ballistic material 24 disposed on its top 22, front side 26, left side 28, right side 30, and rear portion 31. The chair 14 has a back 32, a seat 34 and a plurality of legs 36 and also having ballistic material 24 attached to its back 38 and to its legs 40. The arm 18 is curved so as to extend from a pivot 20 disposed underneath a top 22 of the desk 12 and extending to an attachment plate 42 disposed on an underside of the seat 34. Also shown is handle 44 disposed on the front of the seat 34 of the chair 14 for easily being grasped by the hands 46 of the user 16 so as to move the chair portion away from and toward the desk portion 12. A user arm rest or extension 52 is also shown.

Figure 3:
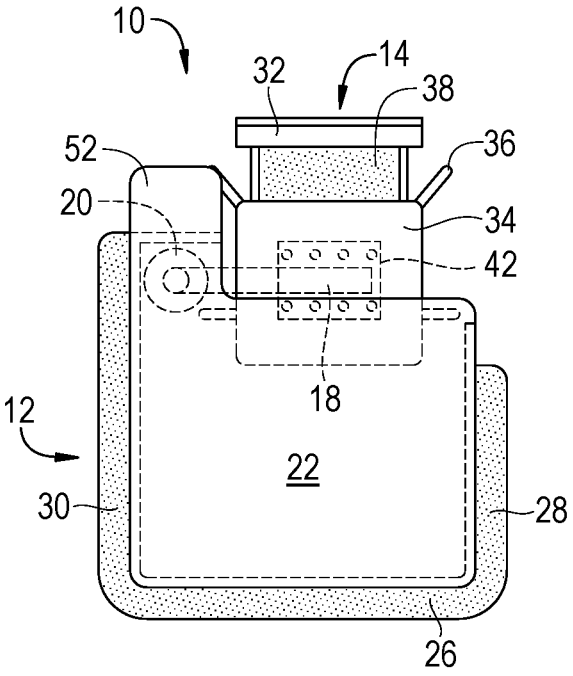
FIG. 3 is a top view of the present invention shown in the normal or static position.

Turning to FIG. 3, therein is shown the present invention 10 with the chair 14 in the normal seated position or static position relative to the desk 12 and showing other elements of the present invention as previously disclosed. This position is useful for a student or user sitting at the desk for studying and for writing and so that a user can get into or get up from the chair with the front end portion of seat 34 of chair 14 extending into a rear opening slightly underneath the top 22 of desk 12.

Figure 4:
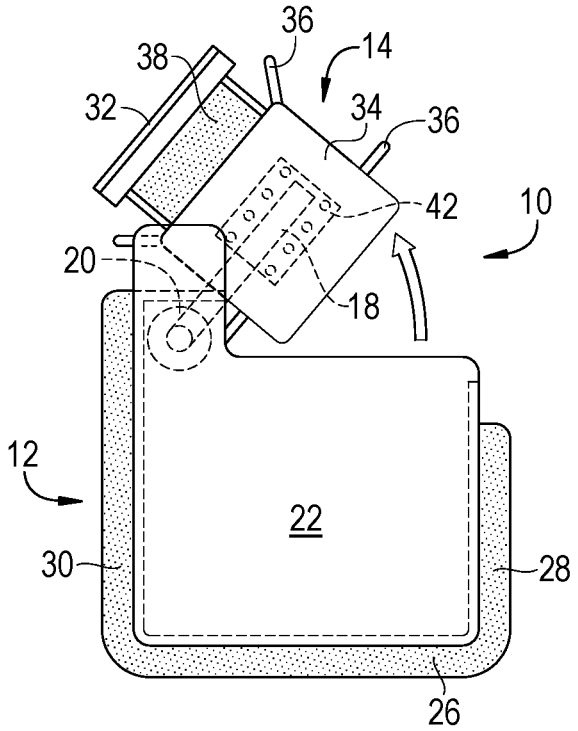
FIG. 4 is a top view of the present invention shown in the open or access position.

Turning to FIG. 4, therein is shown the present invention 10 with the chair 14 moved to the open or access position relative to the desk 12 and showing other elements of the present invention as previously disclosed. In this position the chair 14 is moved away from the desk 12 so that a user can more easily get under the desk 12 and so that a user can get into or get up from the chair.

Figure 5:
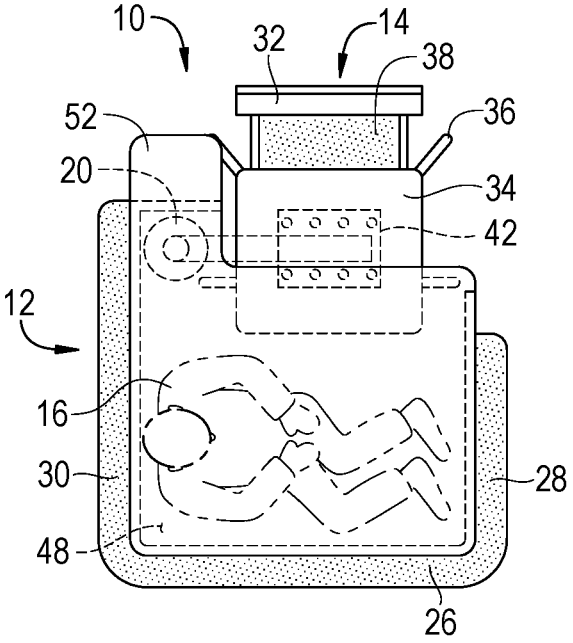
FIG. 5 is a top view of the present invention showing the user inside the safety zone area.

Turning to FIG. 5, therein is shown the present invention 10 with the chair 14 moved back to a closed position relative to desk 12 with a user 16 inside the space or safe zone space 48 or safety zone created by enclosing the interior of the desk 12 and with the front end portion of seat 34 of chair 14 extending into a rear opening underneath the top 22 of desk 12 and showing other elements of the present invention as previously disclosed.

Figure 6:
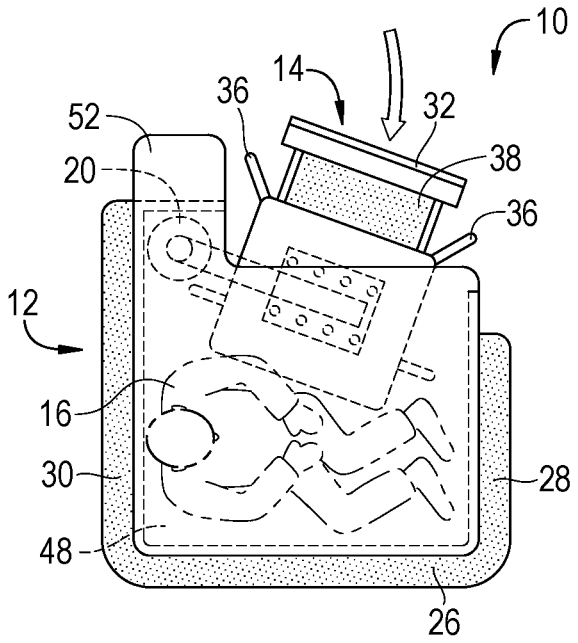
FIG. 6 is a top view of the present invention showing the fully engaged position.

Turning to FIG. 6, therein is shown the present invention 10 with the chair 14 moved into a closed or fully engaged position relative to the desk 12 showing a user 16 inside the space or safe zone space 48 created by the chair/desk assembly being in the fully engaged position with the user in the safety zone space formed by the present invention 10 and showing other elements of the present invention as previously disclosed. In this position the user 16 is nearly completely surrounded by ballistic material with the front end portion of seat 34 of chair 14 extending into a rear opening underneath the top 22 of desk 12.

Figure 7:
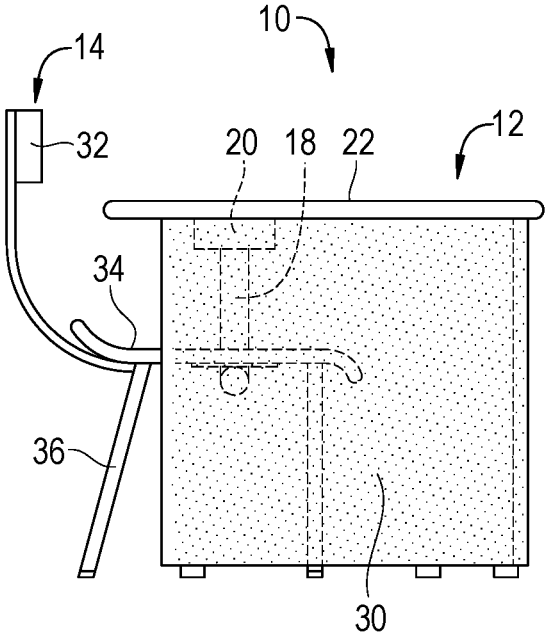
FIG. 7 is a right side view of the present invention in the static position.

Turning to FIG. 7, therein is shown the present invention 10 with the chair 14 in the static position relative to the desk 12 and showing other elements of the present invention as previously disclosed.

Figure 8:
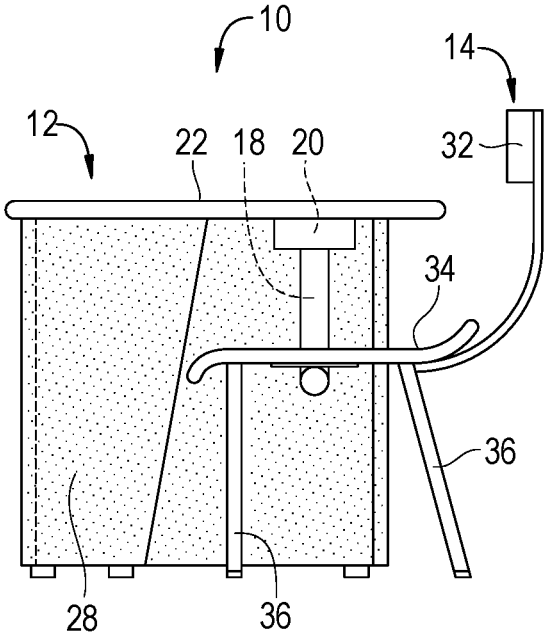
FIG. 8 is a left side view of the present invention shown in the static position.

Turning to FIG. 8, therein is shown the present invention 10 with the chair 14 in the static position relative to the desk 12 and showing other elements of the present invention as previously disclosed.

Figure 9:
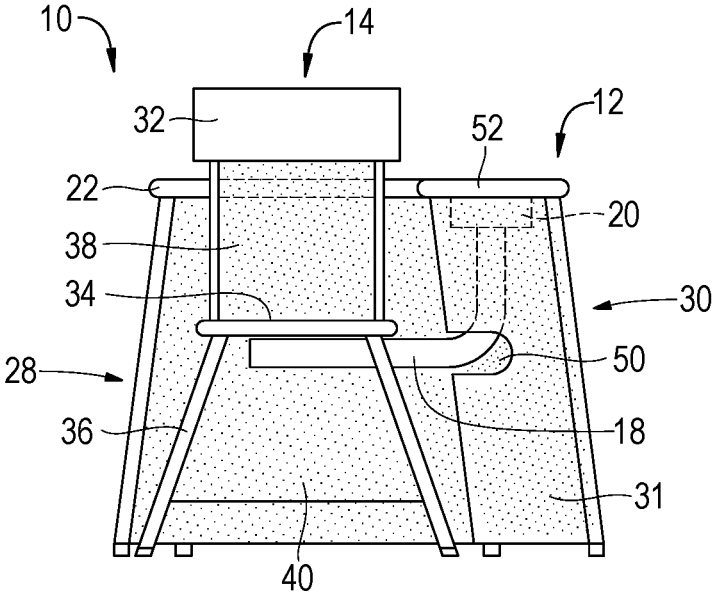
FIG. 9 is a rear side view of the present invention shown in the static position.

Turning to FIG. 9, therein is shown the present invention 10 with the chair 14 in the static position relative to the desk 12. Shown is the rear ballistic material panel 31 with the notch 50 for receiving the arm 18 therein and showing other elements of the present invention 10 as previously disclosed.

Figure 10:
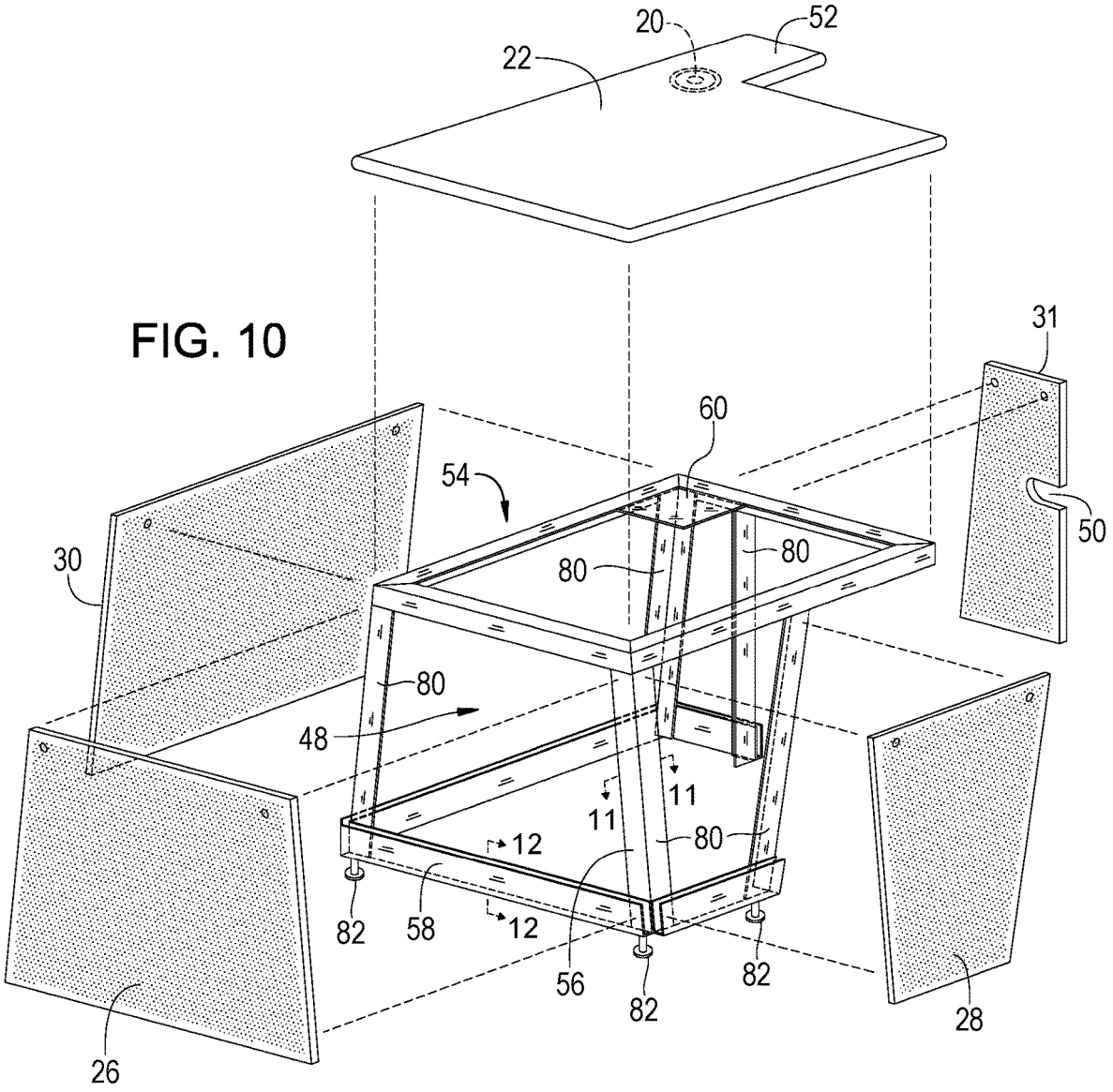
FIG. 10 is an exploded view of the present invention.
Figure 11:
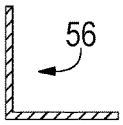
FIGS. 11-12 are cross-section views of portions of the present invention.
Figure 12:
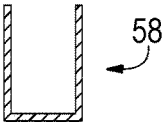

Turning to FIGS. 10-12, therein is shown an underlying framework 54 of the desk 12 to which the ballistic material panels 22, 26, 28, 30, and 31 are attached. Framework 54 is configured to support the top 22 ballistic material sheet/panel in the horizontal plane and the side panels/sheets 26, 28, 30, 31 of ballistic material in the vertical plane; the framework 54 is made of a plurality of angle iron members 56 shown in FIG. 11 and channel members 58 as shown in FIG. 12. The framework 54 together with ballistic panels 22, 26, 28, 30 and 31 thereto form an enclosure around the space or safe zone space 48 formed on the inside of the framework 54. A platen member area 60 is also shown for providing support to the pivot area 20 and arm rest area 52. A plurality of substantially upright legs 80 are formed by the angle iron 56 frame for supporting the ballistic material thereon with adjustable height feet 82 being disposed on the ground contacting ends thereof. The channel members 58 are disposed on the lower outer surfaces of the legs 80 so that the lower edges of the individual panels/sheets of ballistic material can be supported therein around the outer perimeter of the framework 54. The individual members of the framework 54 could be joined together by bolts or welding as would be done in the standard manner by one skilled in the art.

Figure 13:
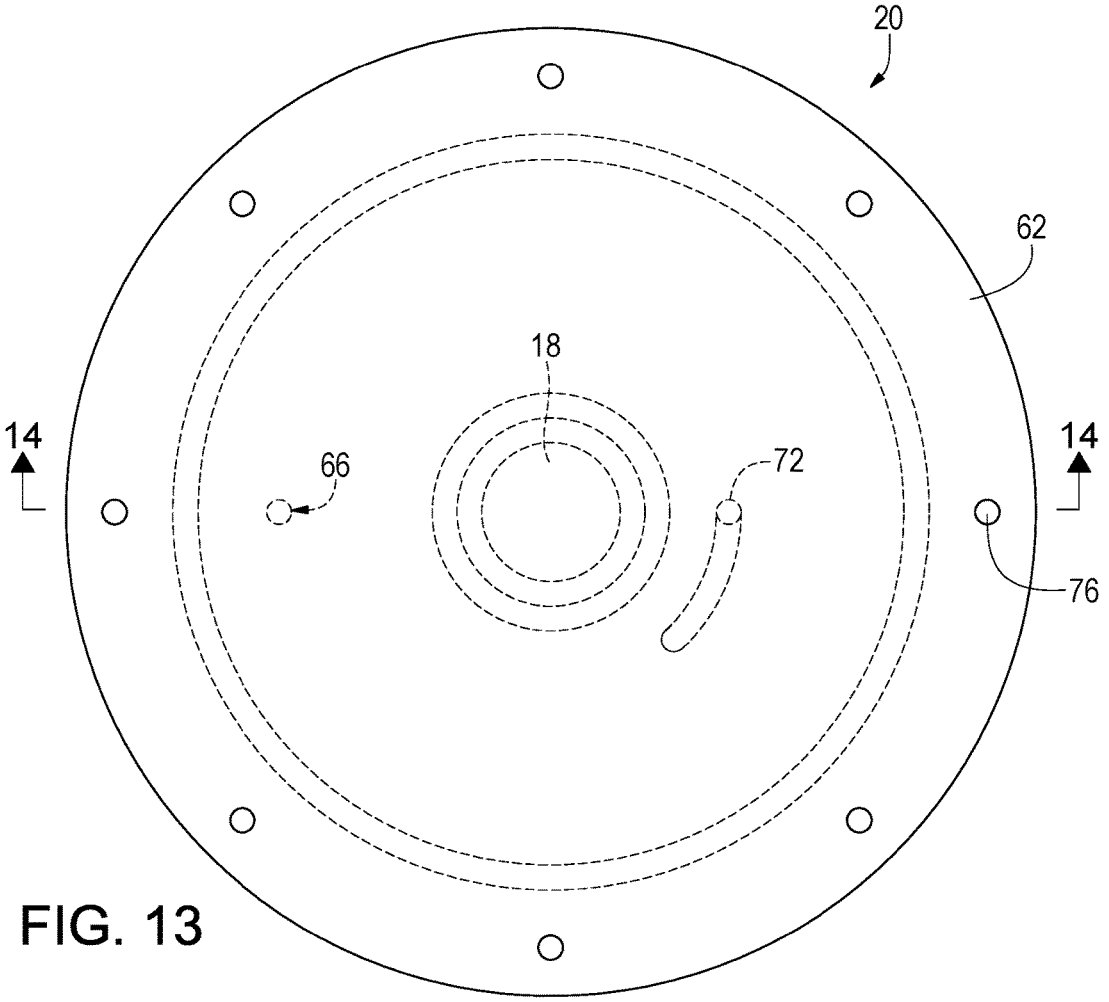
FIG. 13 is a plan view of the pivot of the present invention taken from underneath the top of the desk of the present invention.
Figure 14:
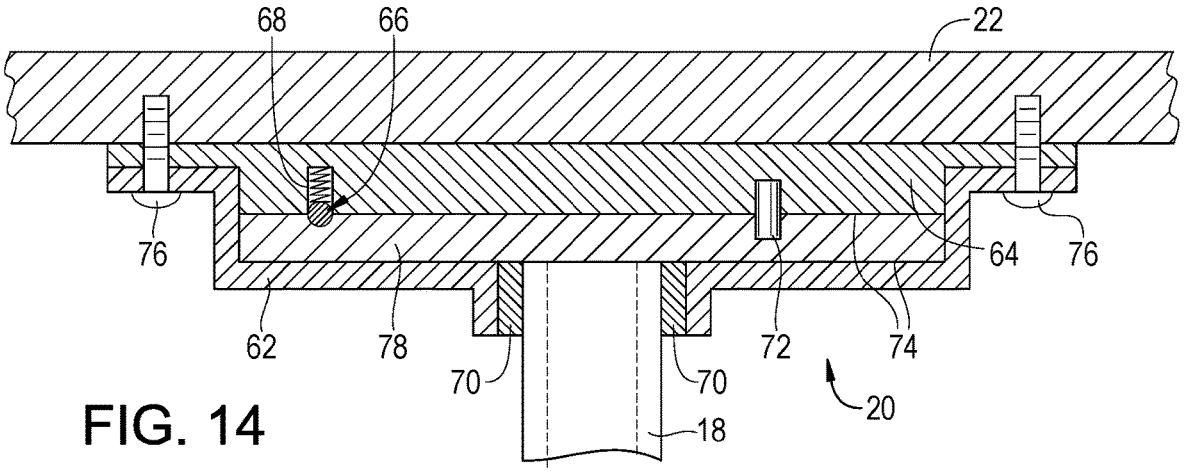
FIG. 14 is a cross sectional view taken from FIG. 13 as indicated.

Turning to FIGS. 13-14, therein is shown the detailed description of the pivot 20 showing the outer cover 62, the chair post/arm 18, the detent plate 64, the desk top 22, the detent ball/spring 66, the detent cavity 68, the bronze bushing 70, the stop pin 72, the teflon surface 74, the screws 76 and rotating plate 78 of the post 18. It should be clear that the pivot 20 is disposed underneath the top 22 of the desk 12 and allows the chair 14 to be pivotally and securely attached to the desk so that the chair is always in position to be converted into a safety zone by the student/user 16 in the event of an emergency shooting incident. The detent ball/spring 68 and related elements are designed to provide resistance to movement between the various positions, i.e., the static, access and fully engaged positions, (as shown in FIGS. 3,4, and 6) of the present invention 10. There are many pivot 20 designs which could be substituted for that shown herein.

The term "ballistic material" as used in this specification applies to any material that is formed of bullet resistant material that would be known to one skilled in the art to be effective for absorbing the shock and energy of being hit by a bullet or like projectile and could be made of many types of materials including metals, plastics or the like and including both soft and hard materials. The thickness and weight of the ballistic material would vary according to the level of bullet resistant desired by a user and the application for which the present invention 10 is being used. The ballistic material allows the present invention 10 to be used for creating a safety zone inside a school room during a shooting incident or for providing protection from falling or flying debris from an explosion and during a tornado. Examples of ballistic material include KEVLAR, GOLD SHIELD, and SPECTRASHIELD, however, there are more types other than these.

Left and right side designations regarding the present invention 10 are interpreted from the view of one seated in the chair portion 14 and facing forwardly, i.e., toward the front end 26. The top 22 is shown unshaded in all the drawings for clarity and contrast, however, it is also made of or includes ballistic material 24. Also, lines with arrowheads are sometimes placed on drawings to indicate potential motion or direction of movement of an item illustrated in the drawing.

What is claimed to be new and desired to be protected by Letters Patent is set forth in the appended claims.

We claim:

1. A desk-chair assembly for providing a safe zone for a user comprising:

a) a desk, said desk having top, left, right, front and rear sides, wherein ballistic material panels are attached to said top, said left, said right, said front and said rear sides of said desk to form an enclosure inside said desk surrounded by said ballistic material panels;

b) a chair upon which the user is seated, wherein at least one ballistic material panel is attached to said chair;

c) an arm connecting said chair to said desk, wherein a first end of said arm is pivotally attached to said desk and a second end of said arm is fixedly attached to said chair;

d) wherein said chair is movable by the user between a static position adjacent said desk top in which said user has access to said desk top, an access position in which said chair is swiveled away from said desk to allow said user to sit down or move away from said chair, and a fully engaged position relative to said desk in which said chair is fully swiveled to close off said enclosure inside said desk in which said user is fully enclosed; and e) wherein said enclosure forms a safe zone space is formed under said desk when said chair is in said fully engaged position to permit said user to be disposed in and to be protected in said safe zone space.

2. The desk-chair assembly of claim 1, said desk further comprising an underlying framework to which said ballistic material panels are attached.

3. The desk-chair assembly of claim 2, said framework further comprising an angle iron member.

4. The desk-chair assembly of claim 3, said framework further comprising a channel member.

5. The desk-chair assembly of claim 4, said chair having a seat, a back attached to said seat, and a plurality of ground contacting legs disposed underneath said seat, wherein ballistic material panels are attached to said back of said seat and to said legs so as to protect a user disposed in said safe zone space when said chair is in said fully engaged position.

6. The desk-chair assembly of claim 5, further comprising a plurality of ground contacting leg members disposed on same framework.

7. The desk-chair assembly of claim 6, wherein said legs are adjustable in height.

8. The desk-chair assembly of claim 7, wherein said ballistic material effectively resists penetration by a bullet.

9. The desk-chair assembly of claim 8, further comprising a detent assembly wherein said first end of said arm is pivotally attached to said desk to provide stops at said static, access and fully engaged positions of said chair for providing resistance to movement of the chair between said static, said access and said fully engaged positions.

10. A method for making a desk-chair assembly for providing a safe zone for a user, comprising the steps of:

a) providing a desk having top, left, right, front and rear sides for forming an enclosure having ballistic material panels attached thereto;

b) providing a chair upon which a user is seated having ballistic material panels attached thereto;

c) providing an arm having a first end pivotally attached to the desk and a second end fixedly attached to the chair;

d) moving the chair between a static position in which the user has access to the desk top, an access position in which the chair is swiveled away from the desk to allow the user to sit down or move away from the chair, and a fully engaged position relative to the desk in which the chair is swiveled to close off the enclosure inside the desk in which the user is fully enclosed; and e) forming a safe zone space within the enclosure under the desk when the chair is in the fully engaged position to permit the user to be disposed in and to be protected in the safe zone space.

11. The method of claim 10, in which the desk further comprises an underlying framework to which the ballistic material panels are attached.

12. The method of claim 11, the framework further comprising an angle iron member.

13. The method of claim 12, the framework further comprising a channel member.

14. The method of claim 13, the chair having a seat, a back attached to the seat, and a plurality of ground contacting legs disposed underneath the seat, wherein ballistic material panels are attached to the back of the seat and to the legs so as to protect a user disposed in the safe zone space when the chair is in the fully engaged position.

15. The method of claim 14, further comprising the step of providing a plurality of ground contacting leg members disposed on the framework.

16. The method of claim 15, wherein the legs are adjustable in height.

17. The method of claim 16, wherein the ballistic material effectively resists penetration by a bullet.

18. The method of claim 17, further comprising the step of providing a detent assembly wherein the first end of the arm is pivotally attached to the desk to provide stops at the static, access and fully engaged positions of the chair for providing resistance to movement of the chair between the static, the access and the fully engaged position.

* * * * *